US011304523B2

(12) United States Patent
Kampl

(10) Patent No.: US 11,304,523 B2
(45) Date of Patent: Apr. 19, 2022

(54) FRONT PANEL FOR A DRAWER

(71) Applicant: Julius Blum GmbH, Hoechst (AT)

(72) Inventor: Markus Kampl, Dornbirn (AT)

(73) Assignee: JULIUS BLUM GMBH, Hoechst (AT)

( * ) Notice: Subject to any disclaimer, the term of this patent is extended or adjusted under 35 U.S.C. 154(b) by 56 days.

(21) Appl. No.: 16/931,696

(22) Filed: Jul. 17, 2020

(65) Prior Publication Data

US 2020/0345141 A1 Nov. 5, 2020

Related U.S. Application Data

(63) Continuation of application No. PCT/AT2018/060295, filed on Dec. 12, 2018.

(30) Foreign Application Priority Data

Jan. 26, 2018 (AT) ..... A 50073/2018

(51) Int. Cl.
*A47B 88/95* (2017.01)
*A47B 88/90* (2017.01)
(Continued)

(52) U.S. Cl.
CPC ..... *A47B 88/95* (2017.01); *A47B 88/941* (2017.01); *A47B 88/944* (2017.01); *A47B 96/20* (2013.01);
(Continued)

(58) Field of Classification Search
CPC . A47B 88/938; A47B 88/941; A47B 88/0014; A47B 88/944; A47B 88/0044; A47B 88/95; A47B 88/0051; A47B 2088/0088; A47B 2088/939; A47B 2088/0092; A47B 2088/9441; A47B 2088/0048; A47B 2088/951;
(Continued)

(56) References Cited

U.S. PATENT DOCUMENTS 5,458,413 A 10/1995 Huber et al.
6,413,007 B1 7/2002 Lambright
(Continued)

FOREIGN PATENT DOCUMENTS

AT 511590 A4 * 1/2013 ..... A47B 88/941
CN 101330849 12/2008
(Continued)

OTHER PUBLICATIONS

Translated Description WO2009111807A2, 8 pages (Year: 2009).*
(Continued)

*Primary Examiner* — Andrew M Roersma
(74) *Attorney, Agent, or Firm* — Wenderoth, Lind & Ponack, L.L.P.

(57) ABSTRACT

A front panel includes a decorative plate and a frame for receiving the decorative plate. The decorative plate is received at least partially within the frame in a mounted condition, and the frame includes a locking portion for releasably locking the front panel to a drawer sidewall. A holding device is arranged on an end portion of the decorative plate for receiving the end portion of the decorative plate. The holding device is configured so as to be: (i) separate from the decorative plate and the frame; and (ii) releasably connected to the frame.

18 Claims, 7 Drawing Sheets

(51) Int. Cl.
*A47B 96/20* (2006.01)
*A47B 88/944* (2017.01)

(52) U.S. Cl.
CPC ... *A47B 2088/954* (2017.01); *A47B 2096/207* (2013.01)

(58) Field of Classification Search
CPC ..... A47B 2088/952; A47B 2088/953; A47B 2088/954; A47B 2088/955; A47B 2088/0059; A47B 2088/0062; A47B 2088/0066; A47B 2088/007; A47B 2088/0074; A47B 96/20; A47B 2096/207
See application file for complete search history.

(56) References Cited

U.S. PATENT DOCUMENTS

| | | | | |
|---|---|---|---|---|
| 7,802,856 | B2 | 9/2010 | Hashemi et al. | |
| 8,931,862 | B2 | 1/2015 | Grimm | |
| 9,642,461 | B2 | 5/2017 | Goetz et al. | |
| 9,717,334 | B2 | 8/2017 | Goetz et al. | |
| 10,188,209 | B2 | 1/2019 | Hoffmann et al. | |
| 2007/0090735 | A1 | 4/2007 | Hashemi et al. | |
| 2014/0184047 | A1 | 7/2014 | Grimm | |
| 2015/0374125 | A1 | 12/2015 | Goetz et al. | |
| 2016/0007750 | A1 | 1/2016 | Goetz et al. | |
| 2018/0000242 | A1 | 1/2018 | Hoffmann et al. | |
| 2020/0288865 | A1 * | 9/2020 | Kampl | A47B 88/956 |

FOREIGN PATENT DOCUMENTS

| | | | | |
|---|---|---|---|---|
| CN | 201282846 | | 8/2009 | |
| CN | 102006801 | | 4/2011 | |
| CN | 102058256 | | 5/2011 | |
| CN | 102076246 | | 5/2011 | |
| CN | 103200844 | | 7/2013 | |
| CN | 105228490 | | 1/2016 | |
| CN | 103908085 | | 8/2016 | |
| CN | 106659298 | | 5/2017 | |
| CN | 107567294 | | 1/2018 | |
| DE | 20 2008 008 540 | | 12/2009 | |
| DE | 102012003289 | A1 * | 8/2013 | A47B 88/956 |
| DE | 202015100068 | U1 * | 4/2016 | A47B 88/944 |
| DE | 20 2015 100 068 | | 5/2016 | |
| EP | 0 663 166 | | 7/1995 | |
| EP | 0 740 917 | | 11/1998 | |
| EP | 2 303 063 | | 4/2014 | |
| EP | 3009042 | A1 * | 4/2016 | F16B 12/46 |
| EP | 3058846 | A1 * | 8/2016 | A47B 88/941 |
| EP | 3100641 | A1 * | 12/2016 | A47B 88/941 |
| JP | 2011-515118 | | 5/2011 | |
| JP | 2011-526499 | | 10/2011 | |
| TW | 201019870 | | 6/2010 | |
| WO | 2009/111807 | | 9/2009 | |
| WO | 2012/028489 | | 3/2012 | |
| WO | 2013/029066 | | 3/2013 | |
| WO | WO-2016131579 | A1 * | 8/2016 | A47B 88/941 |
| WO | WO-2016131603 | A1 * | 8/2016 | A47B 88/941 |

OTHER PUBLICATIONS

Translated Description WO2012028489A1, 10 pages (Year: 2012).*
English-language translation of the Office Action dated Apr. 23, 2021 in Chinese Patent Application No. 201880087619.7.
International Search Report dated Feb. 11, 2019 in International (PCT) Application No. PCT/AT2018/060295.

* cited by examiner

FRONT PANEL FOR A DRAWER

BACKGROUND OF THE INVENTION

The present invention relates to a front panel for a drawer, the front panel being formed by at least one decorative plate and frame for receiving the decorative plate, the decorative plate being received at least partially within the frame in a mounted condition and wherein the frame includes at least one locking portion for releasably locking the front panel to a drawer sidewall.

Furthermore, the invention concerns a drawer comprising a front panel of the type to be described, and a method for assembling a front panel.

WO 2009/111807 A2 and WO 2012/028489 A1 each disclose drawers having a front panel which is formed by a plurality of wall elements configured to be connected to one another. Each of the wall elements arranged on the end portions of the front panel includes a locking portion or an adaptor protruding transversely from the front panel, and the front panel can be releasably locked to the two sidewalls by the locking portion or the adaptor.

SUMMARY OF THE INVENTION

An object of the present invention is to propose a front panel of the type mentioned in the introductory part, in which the mounting of the decorative plate on the frame can be easily performed.

According to the invention, at least one holding device is arranged on at least one end portion of the decorative plate. The at least one holding device is configured to receive the at least one end portion of the decorative plate, being separate from the decorative plate and the frame and being configured to be releasably connected to the frame.

In this way, the decorative plate can be inserted into the frame in a first mounting step. In a further mounting step, the decorative plate can be releasably connected to the frame by the separate holding device, and the decorative plate, in a condition in which the holding device is connected to the frame, is located in its mounted condition and is held in position by the frame.

In one embodiment, the separate holding device is configured to be releasably connected to the frame by at least one snap-connection device. In this way, the holding device can be connected to the frame in a form-locking manner by at least one locking element configured to be elastically bendable or deformable and by a subsequent snapping-back action of the at least one locking element. Such snap-connection devices are known from various embodiments according to the prior art and need not to be described in greater detail here.

The front panel can have a visible side facing towards the outside, and an opposing rear side facing towards the interior of the drawer in the mounted condition. The holding device, in a condition in which the holding device is connected to the frame, is arranged on the rear side of the front panel. In this way, the holding device can be arranged in an aesthetically inconspicuous manner.

A particular advantage of the present invention lies in the fact that the decorative plate can also be connected to the frame by the at least one locking portion when the frame is already locked to the drawer sidewall. This enables a subsequent and comfortable assembly and disassembly, and a simple replacement of the decorative plate on drawers which are already assembled (that is to say, when the frame is already locked to the drawer sidewall by the locking portion being arranged or formed on the frame).

The drawer sidewall is usually configured as a hollow-chamber profile, in which a locking device for releasably locking the locking portion is arranged on a front-end region (that is to say, in a front-end region facing towards the front panel in the mounted position) within the hollow-chamber profile. By introducing the locking portion into the locking device of the drawer sidewall, a locking lever can be released, so that the locking portion of the frame is releasably lockable by a force of a spring.

According to an embodiment, the at least one holding device, in a mounted condition of the decorative plate, at least partially bears against a front face and/or a shell surface of the decorative plate. According to a further embodiment, the at least one holding device embraces, preferably entirely, the end portion of the decorative plate. For this purpose, the holding device, for example, can include an insertion pocket for receiving the end portion of the decorative plate.

The frame can be configured so as to be substantially U-shaped. A first side portion of the U-shaped frame, in the mounted condition of the decorative plate, extends along a first narrow side of the decorative plate, a second side portion of the U-shaped frame extends along a second narrow side of the decorative plate, and a middle portion of the U-shaped frame connecting the first side portion and the second side portion of the U-shaped frame extends along a longitudinal side of the decorative plate.

The frame can include a longitudinally extending carrier profile having a first end region and a second end region, and a side portion is formed or arranged on the first end region and/or on second end region of the carrier profile. The side portion, in a mounted position of the front panel, protrudes upwardly from the carrier profile. Hereby, the carrier profile can have at least one groove extending in the longitudinal direction of the carrier profile, the groove being configured to receive a longitudinal side of the decorative plate. The decorative plate, when mounted to the frame, can be introduced with the lower longitudinal side into the groove of the carrier profile. After having been introduced into the groove, the decorative plate can be pivoted about an axis extending in the longitudinal direction of the decorative plate. After having been pivoted, the decorative plate can be releasably locked to the frame by the holding device. The frame can have a one-piece, a multi-piece or also a monolithic configuration.

The decorative plate can be made of glass, for example of a transparent, translucent or satin-finished glass. Alternatively, the decorative plate can be made of wood, plastic, metal, ceramic, stone or a composite material.

The drawer according to the invention comprises at least one front panel of the described type.

The method for assembling a front panel is characterized by the following steps:

- in a first method step, the frame is provided,
- in a second method step, the holding device is arranged on at least one end portion, preferably on both end portions, of the decorative plate, and
- in a third method step, the decorative plate, together with the holding device, is releasably connected to the frame.

BRIEF DESCRIPTION OF THE DRAWINGS

Further details and advantages of the present invention will be explained with the aid of the following description of figures, in which.

DETAILED DESCRIPTION OF THE INVENTION

Figure 1:
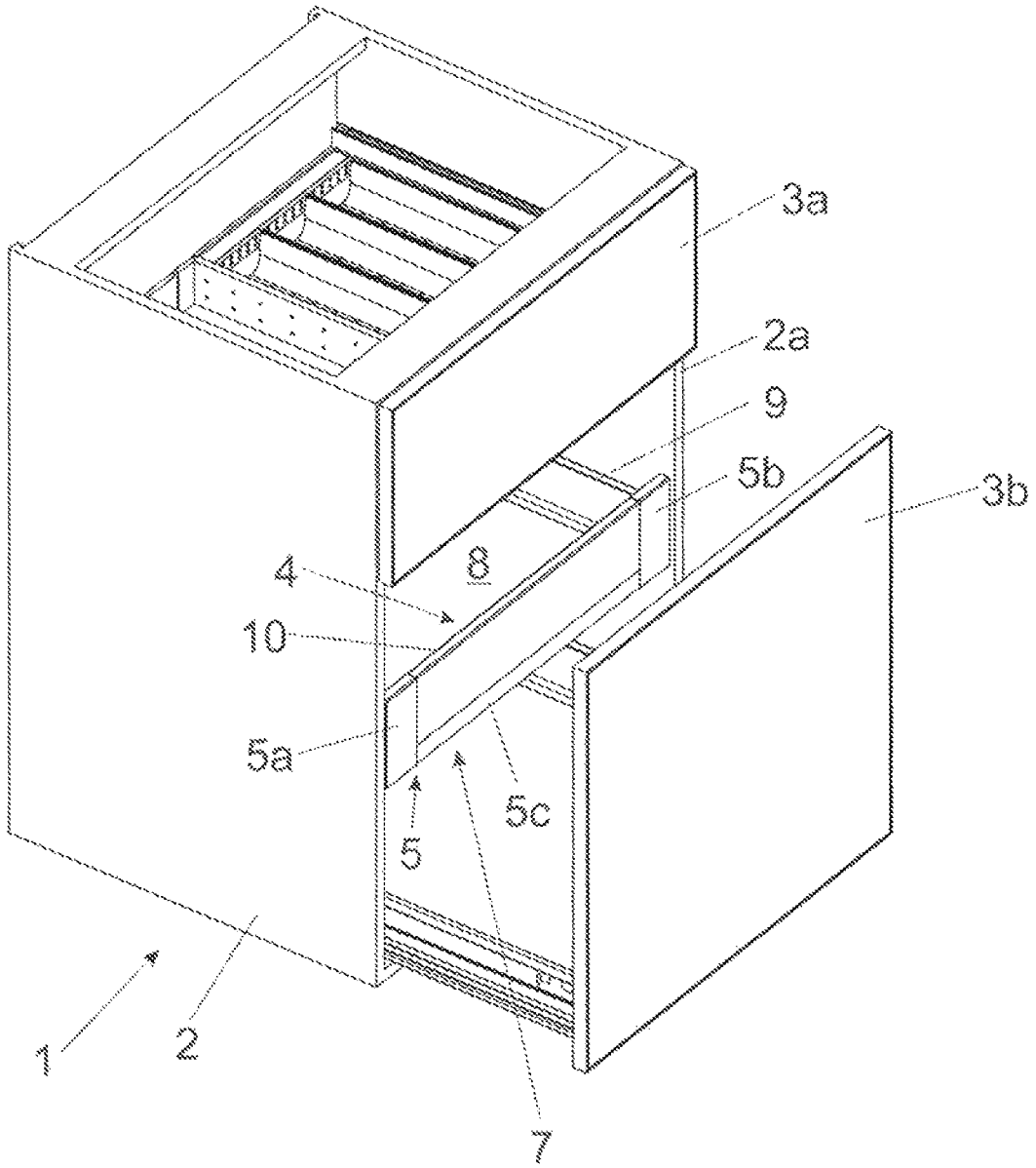
FIG. 1 is a perspective view of an item of furniture with drawers displaceably supported relative to a furniture carcass.

FIG. 1 is a perspective view of a cupboard-shaped item of furniture 1 comprising a furniture carcass 2, and drawers 3*a*, 3*b* and 4 are displaceably supported relative to the furniture carcass 2 by drawer pull-out guides (not shown). The front panels of the two drawers 3*a*, 3*b*, in the closed position, bear against a front face 2*a* of the furniture carcass 2. The drawer 4, on the contrary, can be configured as a so-called extendable internal drawer, and the front panel 7 of the drawer 4 is formed by at least one decorative plate 10 and a frame 5 for receiving the decorative plate 10. The frame 5 is substantially U-shaped and includes, in the shown embodiment, two side portions 5*a*, 5*b* and a longitudinally extending carrier profile 5*c* (for example in the form of an extruded aluminum profile) arranged between the side portions 5*a*, 5*b*. The frame 5 with the side portions 5*a*, 5*b*, together with the carrier profile 5*c*, can have either an integral one-piece construction or, alternatively, as components configured to be fixed to one another. The front panel 7 of the drawer 4 configured as an extendable internal drawer does not abut against the front face 2*a* of the furniture carcass 2 in the closed position of the drawer 4, but is rather arranged between the two sidewalls of the furniture carcass 2 in the closed position. The drawer 4 includes a drawer bottom 8 and drawer sidewalls 9, and the front panel 7 of the drawer 4 can be covered by a large front panel of the lower drawer 3*b*.

Figure 2A:
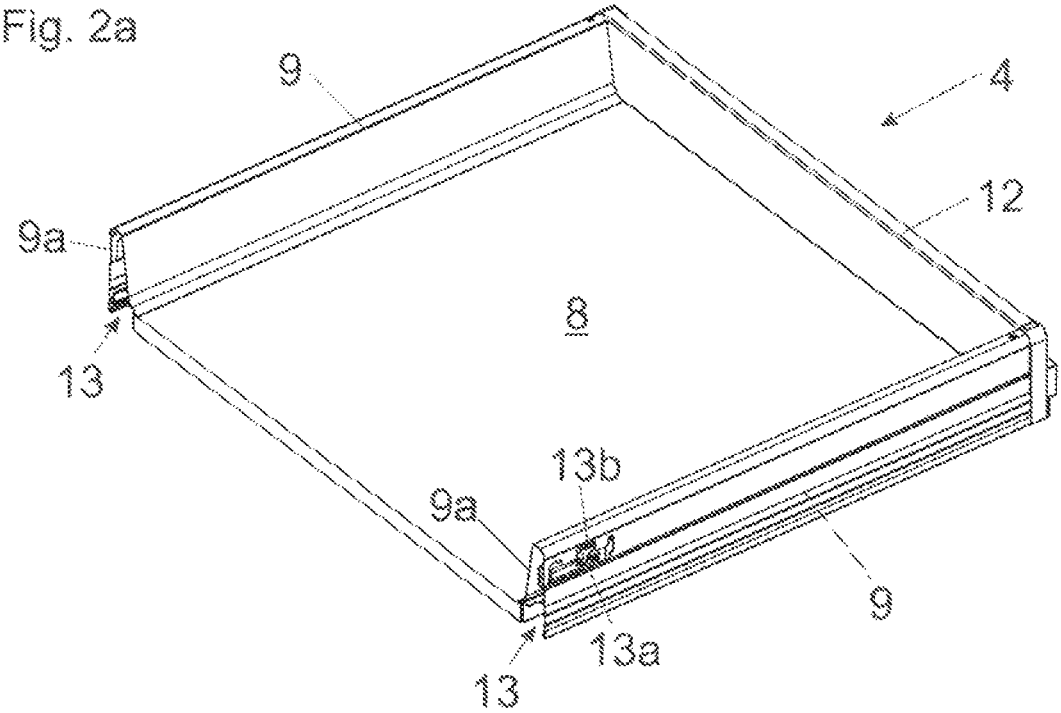
FIG. 2*a*, 2*b* are perspective views of the drawer and of the front panel to be fixed thereon.

FIG. 2*a* is a perspective view of the drawer 4 comprising two opposing drawer sidewalls 9, a drawer bottom 8 and a rear wall 12. Each of the drawer sidewalls 9 is configured as a hollow-chamber profile in which—as is well known—a locking device 13 is arranged for releasably locking the front panel 7. The locking device 13 usually includes a locking lever 13*a* which is pre-stressed by a spring 13*b*, and the locking lever 13*a* is configured to be releasably locked to a locking portion 14*a*, 14*b* (see FIG. 2*b*) of the frame 5. In order to mount the front panel 7, the locking portions 14*a*, 14*b* are each introduced into the front end region of the drawer sidewalls 9, whereby the locking lever 13*a* of the locking device 13 can be released, and the front panel 7 can be pulled against the front face 9*a* of the drawer sidewalls 9 by a force of the springs 13*b*. Such locking devices 13 are well known according to the prior art (for example in EP 0 740 917 B1) and need not to be further described in greater detail here.

Figure 2B:
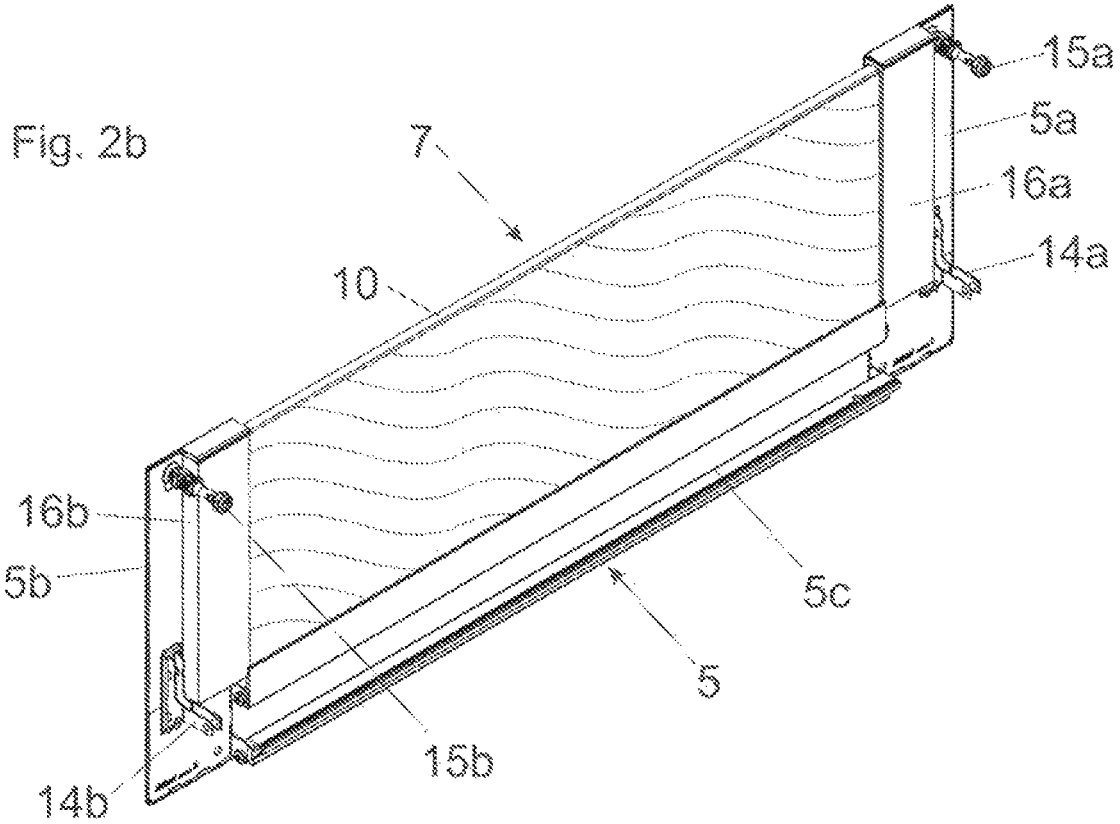

FIG. 2*b* shows the front panel 7 to be fixed to the drawer sidewalls 9 in a perspective view from the rear, in which the decorative plate 10 is located in its mounted condition. The frame 5 can include a longitudinally extending carrier profile 5*c*, and a side portion 5*a*, 5*b* protruding upwardly is arranged on each of the end regions of the carrier profile 5*c*. Each of the side portions 5*a*, 5*b* includes a locking portion 14*a*, 14*b* configured to be releasably locked to the locking device 13 arranged within the drawer sidewall 9. Further, a connecting pin 15*a*, 15*b* can be fixed to the side portions 5*a*, 5*b*, the connecting pin 15*a*, 15*b* being configured to be releasably connected to a railing strut (not shown), the railing strut extending in the longitudinal direction of the drawer sidewall 9 with a predetermined distance above the drawer sidewall 9 in the mounted position. The two end portions of the decorative plate 10 are received in holding devices 16*a*, 16*b* which are to be fixed, preferably without the use of a tool, to the side portions 5*a*, 5*b*. This can be accomplished, for example, by a snap-connection device which is well-known according to the prior art.

Figure 3A:
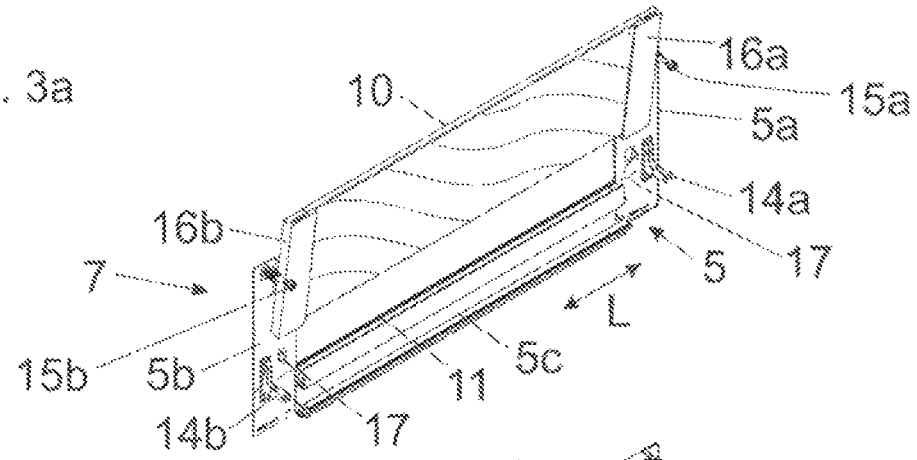
FIG. 3*a*-3*d* show the mounting operation of the decorative plate on the frame in temporally subsequent steps.
Figure 3B:
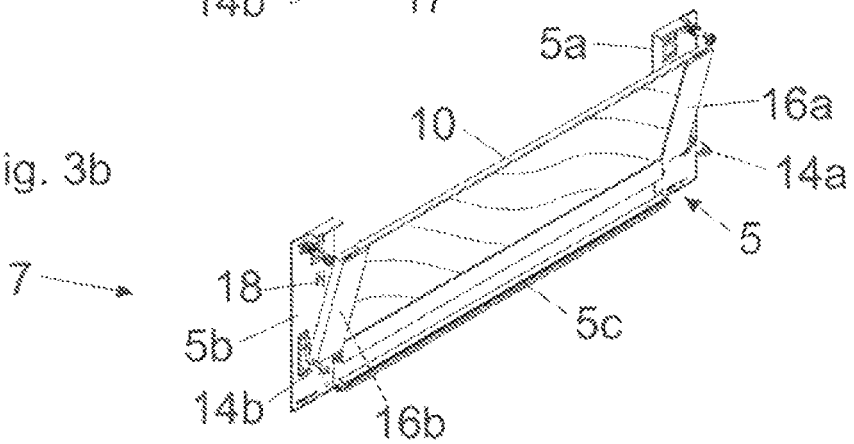

FIG. 3*a*-3*d* show the mounting operation of the decorative plate 10 on the frame 5 in temporally subsequent steps. The longitudinally extending carrier profile 5*c* of the frame 5 can include a groove 11 for receiving a lower longitudinal side of the decorative plate 10, the groove 11 extending in a longitudinal direction (L). For example, an elastomer strip can be arranged within the groove 11, the elastomer strip being provided for preventing rattling noises. In a first step, the frame 5 is provided, for example by assembling the carrier profile 5*c* with the side portions 5*a*, 5*b*. In a second step, a holding device 16*a*, 16*b* is arranged on at least one end portion, preferably on both end portions, of the decorative plate 10 (FIG. 3*a*). It is visible that at least one protrusion 17, 18 (see FIG. 3*a*, 3*b*) is arranged on the side portions 5*a*, 5*b* of the frame 5, the at least one protrusion 17, 18 having an inclined surface portion 17*a*, 18*a* (FIG. 5*a*) arranged thereon, the function of which will be later explained.

Figure 3C:
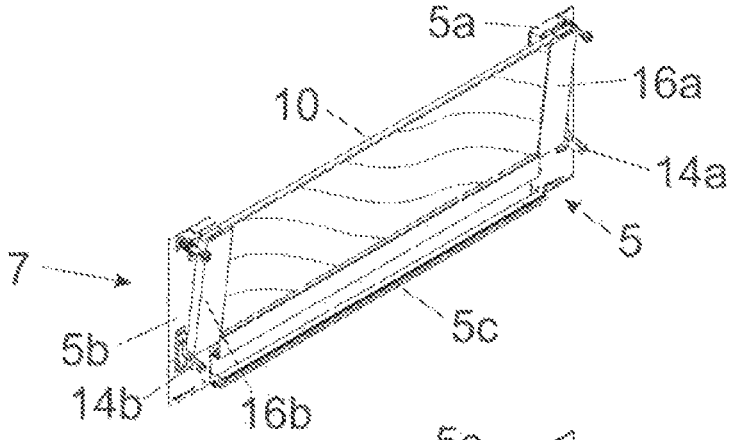
Figure 3D:
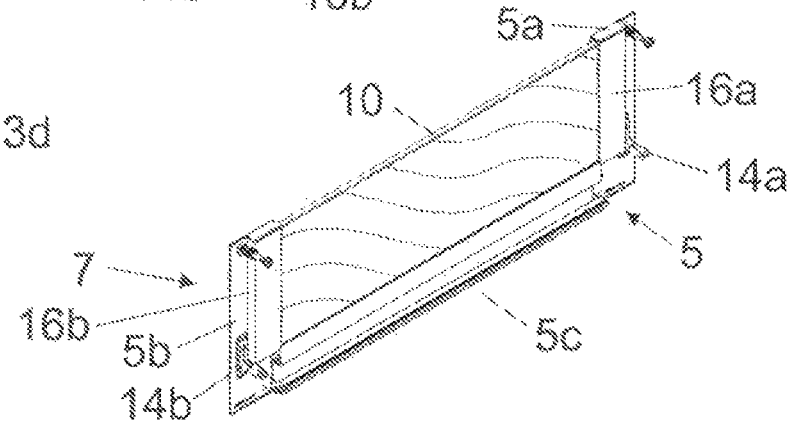

In a further step, the decorative plate 10 is introduced with its lower longitudinal side into the groove 11 of the carrier profile 5*c* of the frame 5 (FIG. 3*b*), whereupon the decorative plate 10 introduced into the groove 11 is pivoted about an axis extending in the longitudinal direction of the decorative plate 10 (FIG. 3*c*). When the holding devices 16*a*, 16*b* arranged on the end portions of the decorative plate 10 and the side portions 5*a*, 5*b* are arranged substantially parallel to one another, the holding devices 16*a*, 16*b* and the side portions 5*a*, 5*b* can be automatically locked to one another (FIG. 3*d*), for example by at least one snap-connection device. As a result, the decorative plate 10 is held in position relative to the frame 5 by the holding devices 16*a*, 16*b*. In the holding devices 16*a*, 16*b*, clearance compensation elements (for example spring tongues) can also be provided, and the decorative plate 10, in the mounted condition, can be arranged in a play-free manner relative to the holding devices 16*a*, 16*b* in the longitudinal direction (L) and/or in a direction extending transversely to the longitudinal direction (L) by the clearance compensation elements.

Figure 4A:
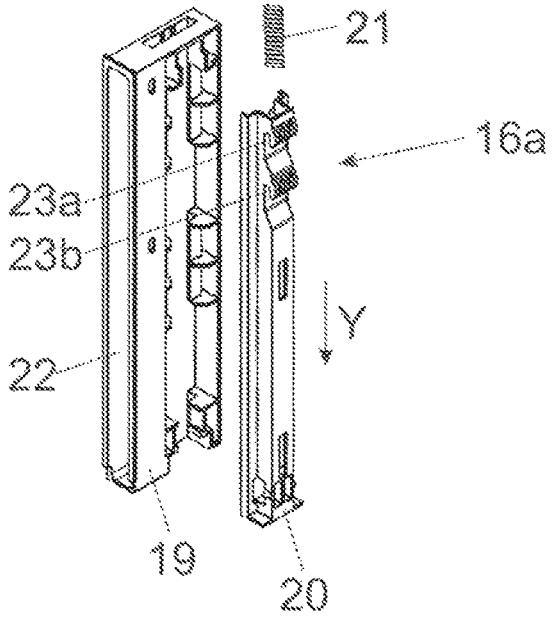
FIG. 4*a*-4*d* show a holding device in an exploded view and in an assembled condition, and cross-sectional views of the holding device in a locked and in an unlocked condition.
Figure 4B:
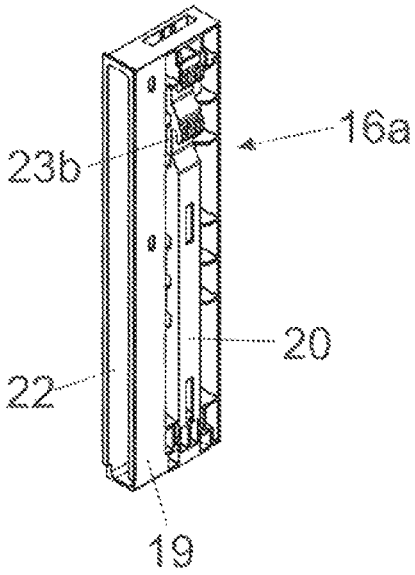

FIG. 4*a* shows an embodiment of a holding device 16*a* in an exploded view. The holding device 16*a* can include at least two components 19, 20 configured to be displaceable relative to one another. A first component 19 is configured so as to receive an end portion of the decorative plate 10, and a second component 20 is configured to be fixed to the frame 5. The first component 19 can include an insertion pocket 22 in which an end portion of the decorative plate 10 can be inserted. The second component 20 can include at least one recess 23*a*, 23*b* configured to be engaged with a limb 24 (FIG. 7) of the side portions 5*a*, 5*b*. By a force storage member 21, for example in the form of a compression spring, the second component 20 is pre-stressed relative to the first component 19. Thus, the second component 20 can be pushed in the direction (Y) relative to the first component 19 by a force of the force storage member 21. Alternatively, the force storage member 21 can also be formed by a material elasticity of a plastic portion. FIG. 4*b* shows the holding device 16*a* in an assembled condition.

Figure 4C:
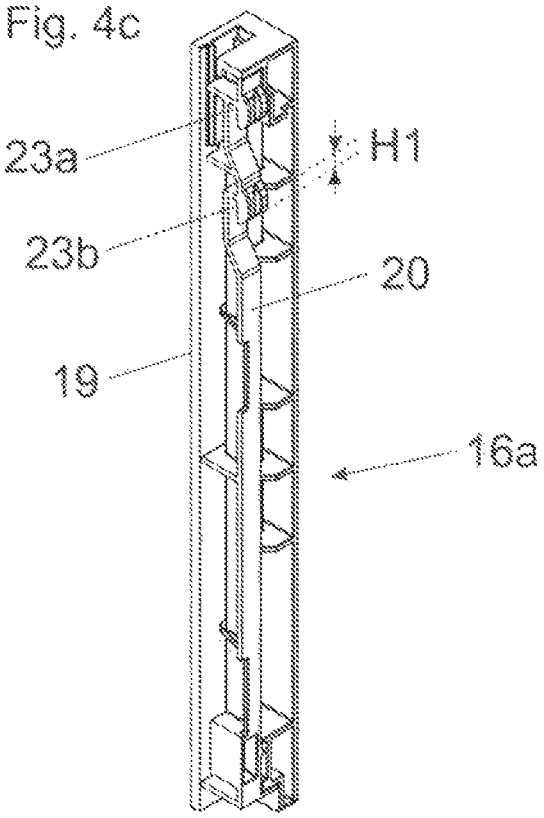
Figure 4D:
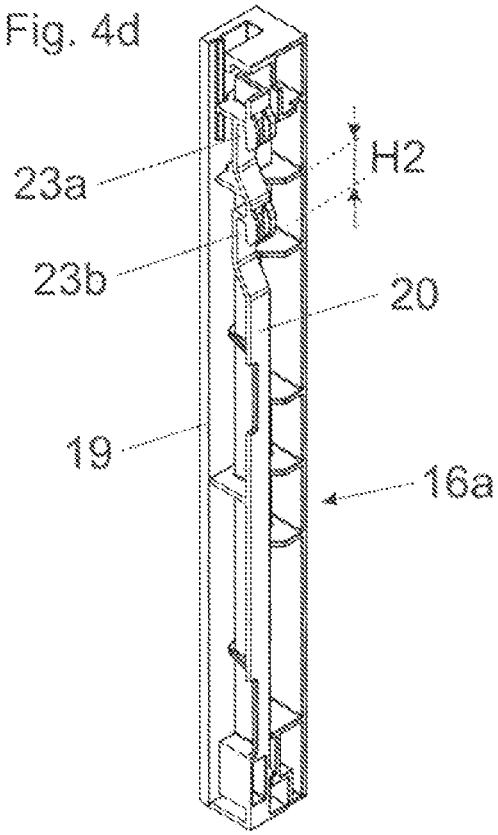

FIG. 4*c* shows a cross-sectional view of the holding device 16*a* in an unlocked condition, in which the force storage member 21 (not shown here) is in a tensed condition. The second component 20 adopts a first height position H1 relative to the first component 19. In the locked condition of the holding device 16*a*, in which the force storage member 21 is in a relaxed condition, the second component 20, on the contrary, adopts a second, lower position H2 (FIG. 4*d*) relative to the first component 19.

Figure 5A:
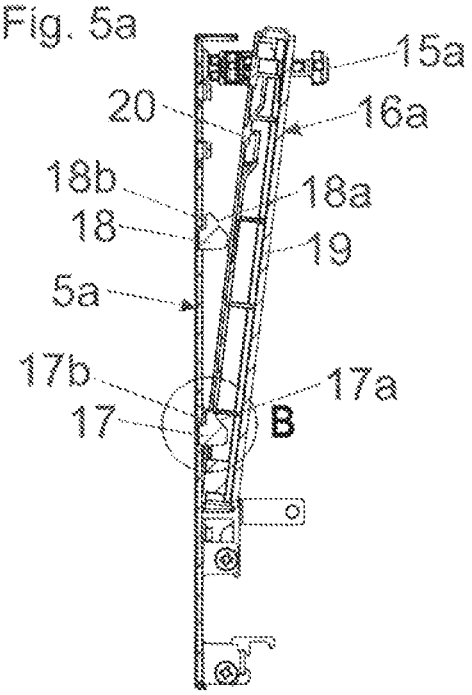
FIG. 5*a*-5*e* show the initial mounting operation of the holding device on the side portion in cross-sectional views and in enlarged detail views.
Figure 5B:
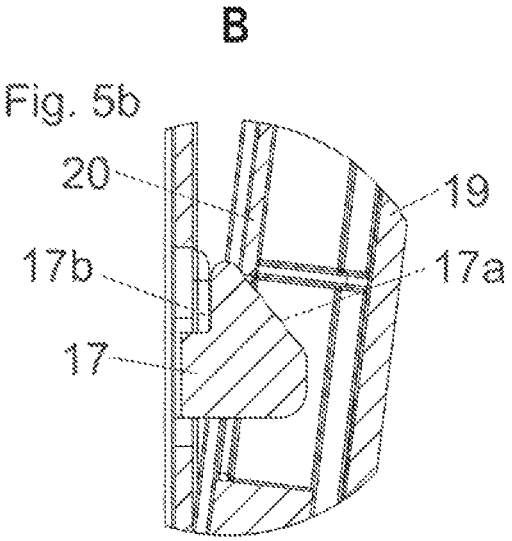

FIG. 5*a* shows a cross-sectional view of the side portion 5*a* with the holding device 16*a* to be fixed thereon. The side portion 5*a* includes two protrusions 17, 18 spaced from one another, and each of the protrusions 17, 18 forms an inclined surface portion 17*a*, 18*a* and a recess 17*b*, 18*b*. In a first step, the decorative plate 10 is inclinedly introduced into the groove 11 of the carrier profile 5*c*. FIG. 5*b* shows the encircled region B of FIG. 5*a* in an enlarged view. By a pivoting movement of the holding device 16*a* in a direction of the side portion 5*a*, the second component 20 is urged upwardly, against a force of the force storage member 21, by the co-operation with the inclined surface portion 17*a* of the protrusion 17.

Figure 5C:
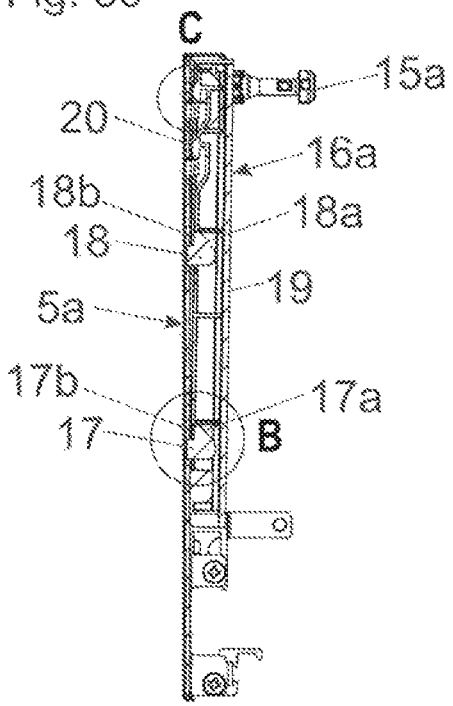
Figure 5D:
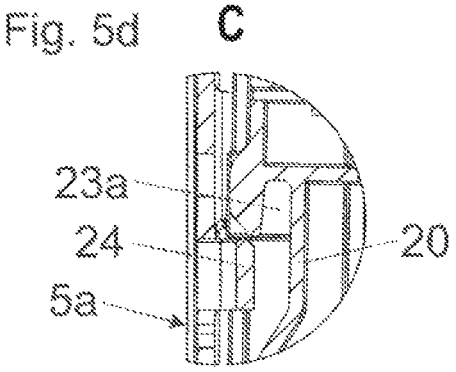
Figure 5E:
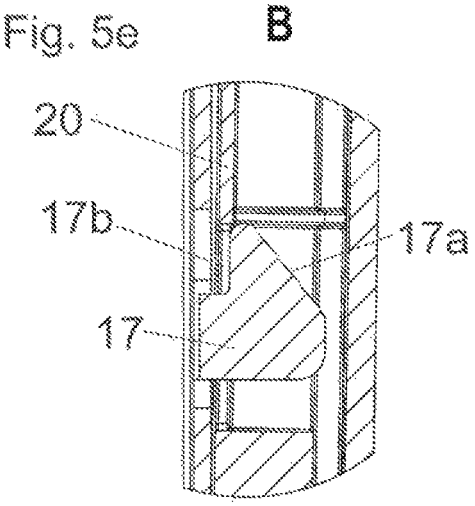

FIG. 5*c* shows a continued pivoting movement of the holding device 16*a* relative to the side portion 5*a* of the frame 5. FIG. 5*d* shows the encircled region C of FIG. 5*c* in an enlarged view, in which the recess 23*a* of the second component 20 is not yet engaged with a limb 24 arranged on the side portion 5*a*. FIG. 5*e* shows the encircled region B of FIG. 5*c* in an enlarged view, in which the second component 20 of the holding device 16*a* has been displaced in an upward direction by gliding along the inclined surface portion 17*a*, whereby the force storage member 21 is maximally loaded.

Figure 6A:
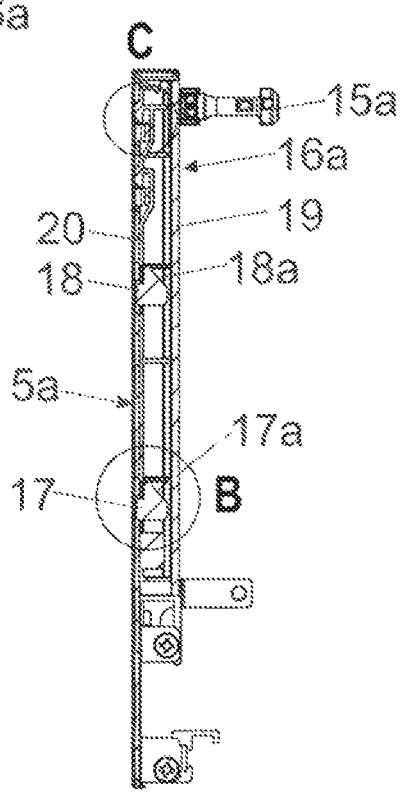
FIG. 6*a*-6*f* show the continued mounting operation of the holding device on the side portion in cross-sectional views and in enlarged detail views.
Figure 6B:
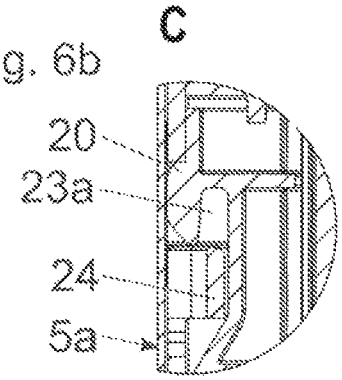
Figure 6C:
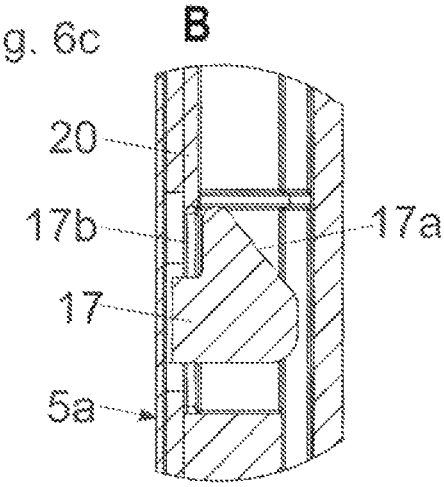

FIG. 6*a*-6*f* show the continued mounting operation of the holding device 16*a* on the side portion 5*a* in cross-sectional views and in enlarged detail views. In FIG. 6*a*, the holding device 16*a* is still located in a slight inclined position relative to the side portion 5*a*, so that a locking is not yet present. FIG. 6*b* shows the encircled region C of FIG. 6*a* in an enlarged view, in which the recess 23*a* of the second component 20 pressurized by the force storage member 21 is not yet locked to the limb 24 of the side portion 5*a*. FIG. 6*c* shows the encircled region B of FIG. 6*a* in an enlarged view, in which the second component 20 is not yet locked to the recess 17*b* of the side portion 5*a*.

Figure 6D:
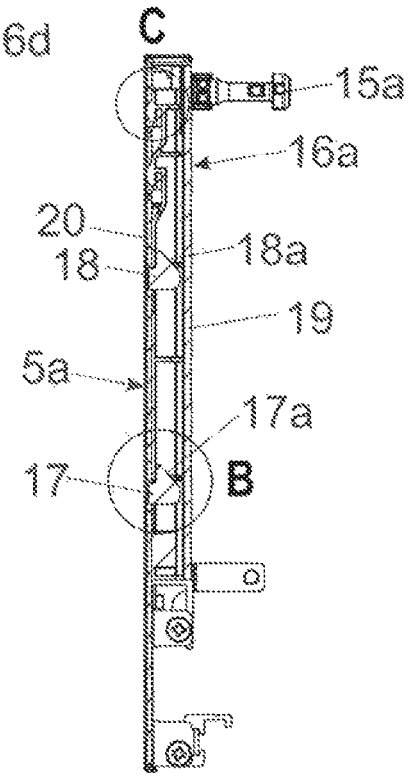
Figure 6E:
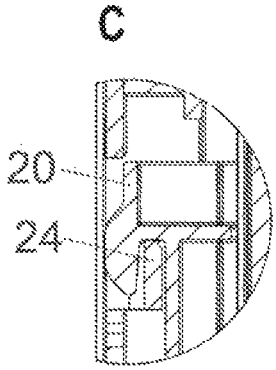
Figure 6F:
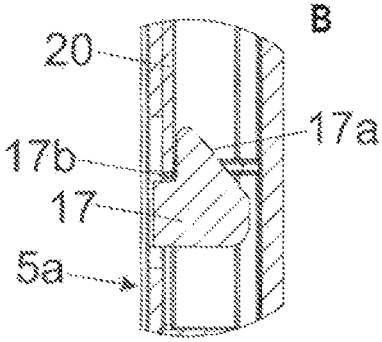

FIG. 6*d* eventually shows the position in which the holding device 16*a* and the side portion 5*a* are aligned parallel to one another and are locked to one another. FIG. 6*e* shows the encircled region C of FIG. 6*d* in an enlarged view, in which the recess 23*a* of the second component 20 is locked to the limb 24 of the side portion 5*a* by a force of the force storage member 21. FIG. 6*f* shows the encircled region B of FIG. 6*d* in an enlarged view, in which the second component 20 has been pushed into the recess 17*b*, formed between the side portion 5*a* and the protrusion 17, by a force of the force storage member 21, so that the holding device 16*a* (and therewith the decorative plate 10) is locked relative to the frame 5.

Figure 7:
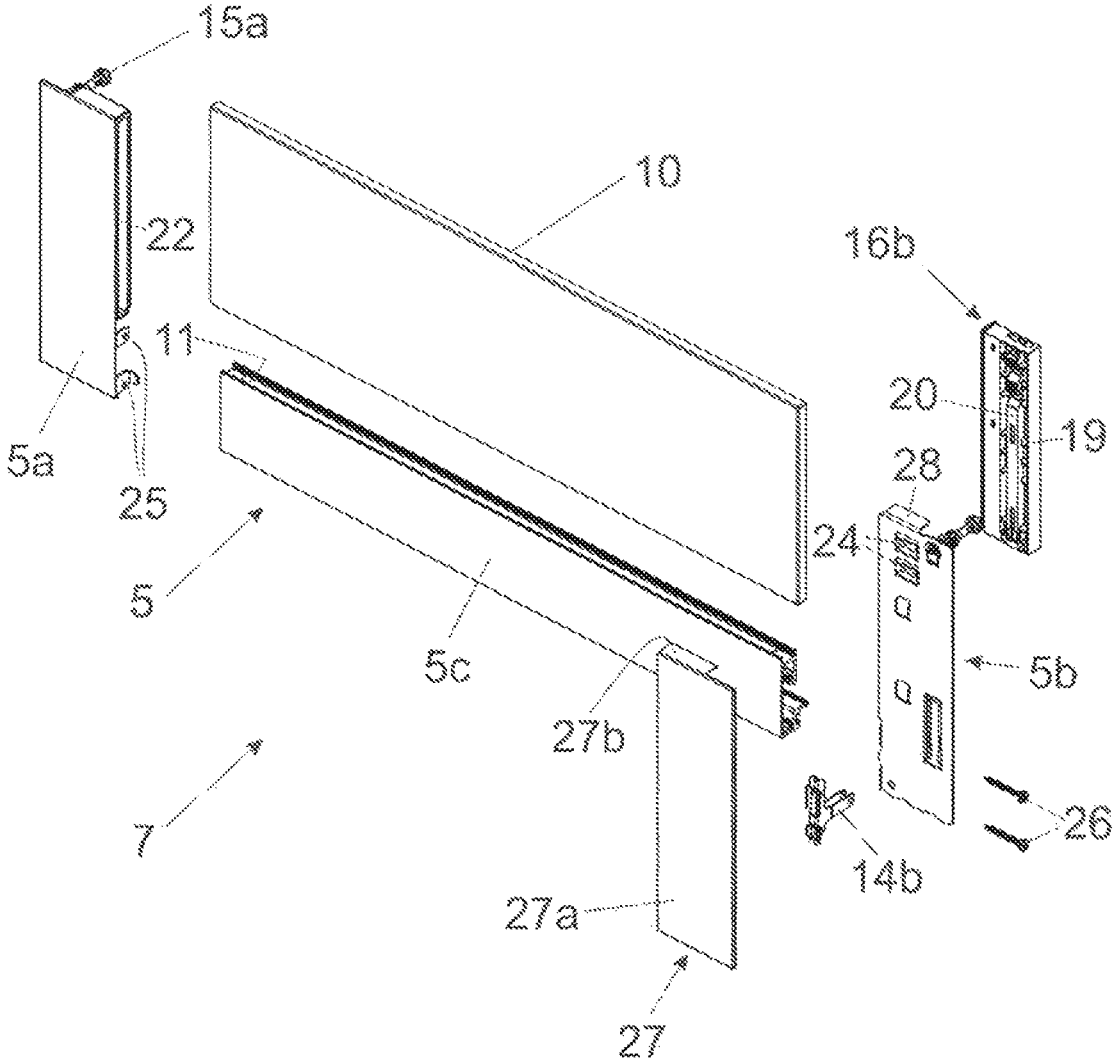
FIG. 7 shows the front panel in an exploded view.

FIG. 7 shows the front panel 7 in an exploded view, in which the multi-part configuration of the frame 5 is depicted. Each of the side portions 5*a*, 5*b* can include flanges 25 for fixing the side portions 5*a*, 5*b* and the carrier profile 5*c* to one another by screws 26. Each of the holding devices 16*a*, 16*b* includes an insertion pocket 22 for receiving an end portion of the decorative plate 10. The insertion pockets 22, in the mounted condition of the decorative plate 10 embrace, preferably entirely, a shell surface of the decorative plate 10. The two limbs 24 of the side portion 5*b* spaced from each other in a height direction can be produced, for example, by stamping and are in engagement with the recesses 23*a*, 23*b* (FIG. 4*a*) of the holding device 16*b* in a locked condition of the holding device 16*b*. By a cover 27 (for example made of aluminum), each of the side portions 5*a*, 5*b* can be covered. The cover 27 includes a first portion 27*a* configured to bear against the side portion 5*b* and a second portion 27*b* protruding at a right angle from the first portion 27*a*, the second portion 27*b* being configured so as to embrace the limb 28 of the side portion 5*b*. Demounting of the decorative plate 10 from the frame 5 is effected such that firstly the cover 27 is removed from the side portion 5*b*. Subsequently, a screwdriver is introduced into an opening formed in a region of the limbs 24, and the second component 20 of the holding device 16*b* can be lifted by the screwdriver. As a result, the locking between the holding device 16*b* and the side portion 5*b* can be released.

The invention claimed is:

1. A front panel for a drawer, the front panel comprising:

at least one decorative plate; and a frame for receiving the at least one decorative plate, wherein:

the at least one decorative plate is received at least partially within the frame in a mounted condition;

the frame includes a locking portion for releasably locking the front panel to a drawer sidewall;

at least one holding device is arranged on at least one end portion of the at least one decorative plate, the at least one holding device being: (i) configured to receive the at least one end portion of the at least one decorative plate; (ii) separate from the at least one decorative plate and the frame; and (iii) configured to be releasably connected to the frame;

the at least one holding device includes a first component and a second component configured to be displaceable relative to one another, the first component being configured to receive the at least one end portion of the at least one decorative plate and the second component being configured to be fixed to the frame;

the first component and the second component are pre-stressed relative to one another by at least one force storage member; and the first component or the second component is movable against a force of the at least one force storage member in a direction extending transverse to a longitudinal direction of the front panel.

2. The front panel according to claim 1, wherein:

the front panel includes a visible side facing outside, and a rear side opposite to the visible side;

the rear side of the front panel is configured to face an interior of the drawer in a mounted condition; and the at least one holding device is arranged on the rear side of the front panel in a condition in which the at least one holding device is connected to the frame.

3. The front panel according to claim 1, wherein the at least one decorative plate can be connected to the frame by the at least one holding device.

4. The front panel according to claim 1, wherein the at least one holding device, in the mounted condition of the at least one decorative plate, at least partially bears against a front face and/or a shell surface of the at least one decorative plate.

5. The front panel according to claim 1, wherein the at least one holding device entirely embraces the at least one end portion of the at least one decorative plate.

6. The front panel according to claim 1, wherein the at least one holding device includes an insertion pocket for receiving the at least one end portion of the at least one decorative plate.

7. The front panel according to claim 1, wherein the frame has a U-shaped configuration.

8. The front panel according to claim 1, wherein:

the frame includes a longitudinally extending carrier profile having a first end portion and a second end portion;

a side portion is arranged or formed on the first end portion of the longitudinally extending carrier profile and/or the second end portion of the longitudinally extending carrier profile; and the side portion protrudes upwardly from the longitudinally extending carrier profile in a mounted position of the front panel.

9. The front panel according to claim 8, wherein the longitudinally extending carrier profile includes at least one groove for receiving a lower longitudinal side of the at least one decorative plate, the at least one groove extending in a longitudinal direction of the longitudinally extending carrier profile.

10. The front panel according to claim 9, wherein the at least one decorative plate, when being mounted to the frame, can be introduced with the lower longitudinal side into the at least one groove of the longitudinally extending carrier profile, and, after having been introduced into the at least one groove, can be pivoted about an axis extending in a longitudinal direction of the at least one decorative plate and, after having been pivoted, can be locked to the frame by the at least one holding device.

11. The front panel according to claim 8, wherein the at least one holding device is configured to be releasably connected to the side portion of the frame.

12. The front panel according to claim 1, wherein at least one protrusion having an inclined surface portion is arranged on the frame, the second component being configured to be moved along the inclined surface portion of the at least one protrusion against a force of the at least one force storage member when the at least one decorative plate is mounted to the frame, and, subsequently, can be locked with at least one recess formed or arranged on the frame by the force of the at least one force storage member.

13. The front panel according to claim 1, wherein:

the locking portion is a first locking portion and the drawer sidewall is a first drawer sidewall; and the frame includes a second locking portion for releasably locking the front panel to a second drawer sidewall.

14. A drawer comprising the front panel according to claim 1.

15. A method for assembling the front panel according to claim 1, the method comprising:

providing the frame;

arranging the at least one holding device on the at least one end portion of the at least one decorative plate; and releasably connecting the at least one decorative plate, together with the at least one holding device, to the frame.

16. The method according to claim 15, wherein the frame is assembled by a longitudinally extending carrier profile and at least one side portion.

17. The front panel according to claim 1, wherein the at least one holding device can be releasably connected to a recess arranged on the frame.

18. A front panel for a drawer, the front panel comprising:

at least one decorative plate; and a frame for receiving the at least one decorative plate, wherein:

the at least one decorative plate is received at least partially within the frame in a mounted condition;

the frame includes a locking portion for releasably locking the front panel to a drawer sidewall;

at least one holding device is arranged on at least one end portion of the at least one decorative plate, the at least one holding device being: (i) configured to receive the at least one end portion of the at least one decorative plate; (ii) separate from the at least one decorative plate and the frame; and (iii) configured to be releasably connected to the frame;

the at least one holding device includes a first component and a second component configured to be displaceable relative to one another, the first component being configured to receive the at least one end portion of the at least one decorative plate and the second component being configured to be fixed to the frame;

the first component and the second component are prestressed relative to one another by at least one force storage member; and at least one protrusion having an inclined surface portion is arranged on the frame, the second component being configured to be moved along the inclined surface portion of the at least one protrusion against a force of the at least one force storage member when the at least one decorative plate is mounted to the frame, and, subsequently, can be locked with at least one recess formed or arranged on the frame by the force of the at least one force storage member.

* * * * *